US010682869B2

(12) United States Patent
Natalis et al.

(10) Patent No.: US 10,682,869 B2
(45) Date of Patent: Jun. 16, 2020

(54) DIGITAL PRINTING PROCESS AND APPARATUS OF A SUBSTRATE IN THE FORM OF CONTINUOUS SHEET

(71) Applicant: ALEPH S.R.L., Lurate Caccivio (CO) (IT)

(72) Inventors: Giovanni Natalis, Pietra Ligure (IT); Roberto Manes, Monza (IT); Alessandro Manes, Monza (IT)

(73) Assignee: ALEPH S.R.L., Lurate Caccivio (IT)

( * ) Notice: Subject to any disclaimer, the term of this patent is extended or adjusted under 35 U.S.C. 154(b) by 0 days.

(21) Appl. No.: 16/168,482

(22) Filed: Oct. 23, 2018

(65) Prior Publication Data

US 2019/0126642 A1 May 2, 2019

(30) Foreign Application Priority Data

Oct. 26, 2017 (IT) ..... 102017000121985

(51) Int. Cl.

| | |
|---|---|
| ***B41J 11/00*** | (2006.01) |
| ***B41J 3/407*** | (2006.01) |
| ***B41J 15/16*** | (2006.01) |
| ***B41J 2/01*** | (2006.01) |

(Continued)

(52) U.S. Cl.

CPC ..... *B41J 11/007* (2013.01); *B41J 2/01* (2013.01); *B41J 3/4078* (2013.01); *B41J 11/001* (2013.01); *B41J 11/002* (2013.01); *B41J 11/0085* (2013.01); *B41J 11/24* (2013.01); *B41J 15/165* (2013.01); *B41J 29/377* (2013.01)

(58) Field of Classification Search

CPC ..... B41J 2/2114; B41J 11/00; B41J 11/0015; B41J 11/002; B41J 11/007; B41J 11/24; B41J 11/001; B41J 11/0085; B41J 29/377; B41J 2/01; B41J 3/4078; B41J 15/165

See application file for complete search history.

(56) References Cited

U.S. PATENT DOCUMENTS

2007/0165088 A1* 7/2007 Maeno ..... B41J 2/14209 347/100
2014/0063122 A1 3/2014 Kanemoto
2016/0325560 A1 11/2016 Milini

FOREIGN PATENT DOCUMENTS

WO WO 2017/060875 4/2017

OTHER PUBLICATIONS

Italian Search Report dated Jul. 5, 2018 for counterpart Italian Patent Application No. 102017000121985.

* cited by examiner

*Primary Examiner* — Kristal Feggins
(74) *Attorney, Agent, or Firm* — Shuttleworth & Ingersoll, PLC; Timothy J. Klima

(57) ABSTRACT

A substrate in the form of a continuous sheet is fed towards a belt conveyor and is lied out on the conveyor itself. By means of the belt conveyor, the substrate is moved along a feed direction, while a printing unit operating above the belt conveyor realizes a print pattern on the substrate. The printed substrate is withdrawn by a traction unit operating downstream of the belt conveyor. In a section of its longitudinal extension between the belt conveyor and the traction unit, the substrate is subjected to a braking action to retain the substrate in contrast to traction actions induced on the same by the traction unit. A drying group operates on the substrate in the area affected by the braking action, with a combined action of radiation and ventilation.

14 Claims, 3 Drawing Sheets

(51) Int. Cl.
*B41J 11/24* (2006.01)
*B41J 29/377* (2006.01)

DIGITAL PRINTING PROCESS AND APPARATUS OF A SUBSTRATE IN THE FORM OF CONTINUOUS SHEET

This application claims priority to Italian Patent Application 102017000121985 filed Oct. 26, 2017, the entirety of which is incorporated by reference herein.

The present invention relates to a digital printing process of a substrate in the form of a continuous sheet. The invention further relates to an apparatus for the digital printing of a substrate in the form of a continuous sheet.

In particular, the invention lends itself to typically be implemented in the use of large-format industrial printers.

The use of printing apparatuses for industrial use is known, which typically employ ink jet to perform digital printing on large-format media. The print media for these uses are usually of paper, polymeric or textile material. By way of example, these printers are commonly used for printing posters, billboards, banners, fabrics for clothing, fabrics for furniture, etc.

An apparatus of this type comprises a feeding unit for feeding the substrate in the form of a continuous sheet, usually by unwinding it from a feeding reel.

The substrate is led from the feeding unit on a belt conveyor by which the substrate itself is moved longitudinally along a predetermined feed direction. A printing unit, normally provided with a plurality of print heads mounted on a carriage which is transversely movable with respect to the feed direction, operates above the belt conveyor to realize print patterns on the substrate.

The translation of the substrate due to the action of the belt conveyor typically features steps of movement alternated with steps of stopping, during which the printing ink is dispensed by the heads.

In order for the substrate to accurately follow the movements imposed by the belt conveyor and thus ensure a proper printing execution, suitable measures are adopted, for example through electrostatic attraction or by distributing an adhesive substance on the conveyor, aimed at favouring an adequate stability of the positioning of the substrate on the belt conveyor.

In document WO 2017/060875 in the name of the same Applicant, the stabilization of the substrate is obtained by means of a suction effect produced through a plurality of through openings arranged on the belt conveyor.

Downstream of the transport group, a traction unit operates which collects the printed substrate, typically by winding it in the form of a roll or reel. The traction unit is mechanically decoupled from the belt conveyor, so that the intermittent translation imposed on the substrate by the transport group can be reconciled with a substantially continuous traction action exerted by the traction unit. More specifically, the traction action is usually entrusted to a dancing roller operating in a thrust relationship at a loop formed by the substrate before reaching the collection reel.

However, the applicant considers that certain aspects of the known apparatuses can be improved.

For example, during the collection of the printed substrate in the form of a roll or reel, it is difficult to obtain the winding of the substrate in an ordered form since, because of various factors which are difficultly controllable, during the winding slip thrusts can be generated which tend to laterally displace the substrate as it is wound.

It has also been found that the accuracy of the printing on the substrate is not always entirely satisfactory.

In this regard the Applicant has observed that in order to obtain high-quality printing, it is necessary to find a fair compromise between the anchoring action of the substrate on the surface of the belt conveyor, regardless of whether it is obtained from a suction system, by electrostatic charges or by an adhesive substance, and the traction action exerted on the substrate itself by the traction unit positioned downstream of the belt conveyor.

In particular it has been observed that, especially on substrates which are particularly thin and/or delicate, the anchoring action, which is necessarily contained in order to avoid compromising the integrity of the substrate, may prove to be inadequate in ensuring an effective retention of the substrate during the execution of the printing operation. On the other hand, when the intensity of the traction action is increased, for example to favour the compact winding of the printed substrate, the accuracy of the printing may not be fully satisfactory.

Moreover, it is sometimes difficult to collect the substrate in the form of a roll by means of an orderly winding action, in which the turns formed by the substrate are radially overlapping in the absence of mutual axial staggering. This circumstance is particularly evident when the substrate must be subjected to additional treatments, for example by means of a drying unit interposed between the transport group and the traction unit, whose presence imposes a lengthening of the path travelled by the substrate itself upstream of the traction unit.

According to the present invention, the limitations of the prior art are overcome by subjecting the substrate to a braking action localized in a section between the belt conveyor and the traction unit.

More in particular, according to a first aspect, the object of the present invention is a digital printing process of a substrate in the form of a continuous sheet, comprising the steps of:

feeding a substrate in the form of a continuous sheet towards a belt conveyor;

laying the substrate on the belt conveyor;

preferably by means of said conveyor belt, translating the substrate along a feed direction;

realizing a print pattern on the substrate by means of a printing unit operating above the belt conveyor;

withdrawing the printed substrate by means of a traction unit operating downstream of the belt conveyor;

subjecting the substrate to a braking action between the belt conveyor and the traction unit, to retain the substrate in contrast to traction actions induced thereon by the traction unit.

According to a second aspect, an object of the invention is a digital printing apparatus of a substrate in the form of a continuous sheet, comprising:

a feeding unit for feeding a substrate in the form of a continuous sheet;

a transport group comprising a belt conveyor configured to receive said substrate from the feed unit and preferably translate the substrate along a feed direction;

a printing unit operating above the belt conveyor in order to realize a print pattern on the substrate;

a traction unit operating downstream of the transport group to withdraw the printed substrate;

further comprising a braking unit operatively interposed between the belt conveyor and the traction unit, to retain the substrate so as to counteract traction actions induced thereon by the traction unit.

The braking action stabilizes the lateral positioning of the substrate, favouring its ordered collection, preferably by winding in the form of a roll or reel, without causing axial misalignments between the turns progressively formed in succession.

Moreover, the braking action partially or totally contrasts the traction exerted by the traction unit along the substrate. Consequently the substrate in the printing area, preserved by the effects of the traction exerted along the substrate itself by the traction unit, is facilitated in maintaining a more stable position, favouring printing precision even during the realization of high resolution graphic motifs. It is also possible to reduce the intensity of the anchoring action of the substrate to the belt conveyor in order to prevent damage during the processing of particularly delicate substrates, without the traction action compromising its stable positioning in the printing area. Where required, it is also possible to increase the intensity of the traction action, for example to facilitate the compaction of the turns formed by the printed substrate that is wound into a reel.

In one or more of the above aspects, the invention further comprises one or more of the following preferential characteristics.

Preferably, the braking action is distributed along a longitudinal section of the substrate.

Preferably, the braking action is distributed in a uniform or substantially uniform manner along said longitudinal section of the substrate.

Preferably, the braking action is carried out by means of a suction action exerted by means of through openings formed in a slide plate skimmed by the substrate.

Preferably, the printed substrate is subjected to a drying action performed along a longitudinal section of the substrate interposed between the belt conveyor and the traction unit.

Preferably, the drying action is performed along a longitudinal section of the substrate affected by the braking action.

Preferably, the drying action is carried out by means of light radiation produced by radiant elements supported in a spaced position from the substrate.

Preferably, the drying action is carried out by means of at least one ventilation flow directed against the substrate.

Preferably, a cooling action of said radiant elements is also provided by means of said ventilation flow, before directing said ventilation flow against the substrate.

Preferably, the substrate laying on the belt conveyor is made to adhere to the belt conveyor itself.

Preferably, said braking unit comprises a slide plate configured to be slidingly skimmed by the substrate and having a plurality of through openings.

Preferably, said braking unit comprises a suction chamber delimited by said slide plate, Preferably, said braking unit comprises a suction unit configured to create a vacuum inside the suction chamber.

Preferably, said through openings are made in the form of slots extending along a feed direction of the substrate.

Preferably, said slots each have a width of less than 3 mm.

Preferably, said slots each have a width comprised between 1.5 mm and 2 mm.

Preferably, said slots each have a length greater than 20 mm.

Preferably, said slots each have a length comprised between 35 mm and 70 mm.

Preferably, said braking unit is integrated with a substrate drying group.

Preferably, the drying group comprises at least one heater suspended at a spaced position from the slide plate.

Preferably, the heater is suspended above the slide plate.

Preferably, the heater comprises a panel, the opposite sides of which are engaged with respective extensions which extend from box-like columns supporting the slide plate.

Preferably, the panel has a box-like structure.

Preferably, said heater comprises radiant elements operatively carried by the panel.

Preferably, said heater further comprises one or more reflective elements carried by the panel and defining a concavity facing the slide plate, for housing the radiant elements.

Preferably, the drying group further comprises ventilation devices configured to provide at least a ventilation flow towards the slide plate.

Preferably, the ventilation devices comprise at least one, preferably two, ventilation units.

Preferably, said ventilation units are each housed inside one of the box-like columns.

Preferably, said ventilation unit delivers a flow of air through the respective side slots arranged at the top of the box-like columns and/or at the respectively opposite sides of the panel.

Preferably, the slots open laterally near a lower surface of the panel and/or inside the same.

Preferably, said ventilation flow skims said radiant elements before reaching the slide plate.

Preferably, the ventilation devices include a ventilation path extending internally to said panel and exiting in the direction of the slide plate, through one or more vent openings obtained in a lower surface of the panel itself.

Preferably, said ventilation unit delivers a flow of air along the ventilation path.

Preferably, anchoring devices are also provided to adhere the substrate to the belt conveyor.

Preferably, the traction unit comprises a winding group configured to collect the substrate in the form of a roll.

Further characteristics and advantages will appear more clearly from the detailed description of a preferred, but not exclusive, embodiment of a process and apparatus for the digital printing of a substrate in the form of a continuous sheet according to the present invention. This description is provided herein below with reference to the attached drawings, which are provided solely for the purpose of providing approximate and thus non-limiting examples, and in which.

Figure 1:
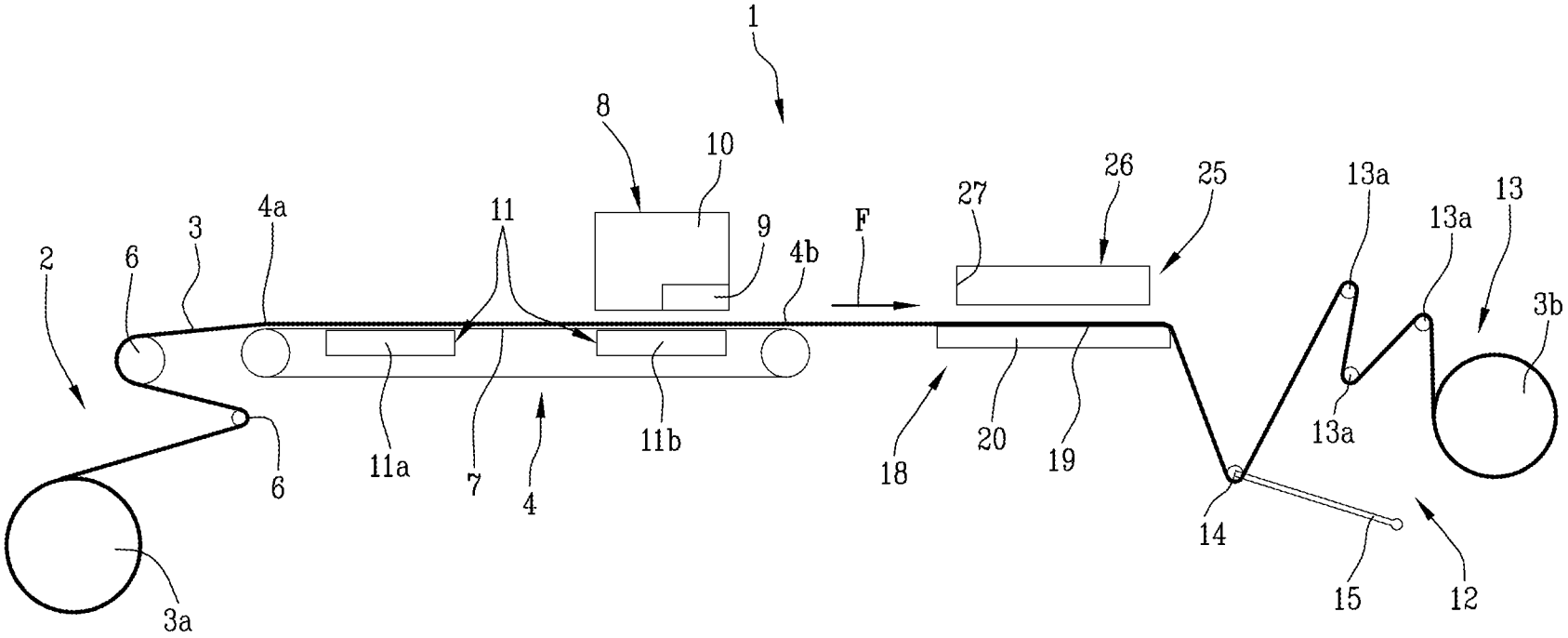
FIG. 1 is a schematic side view of a digital printing apparatus according to the present invention.
Figure 2:
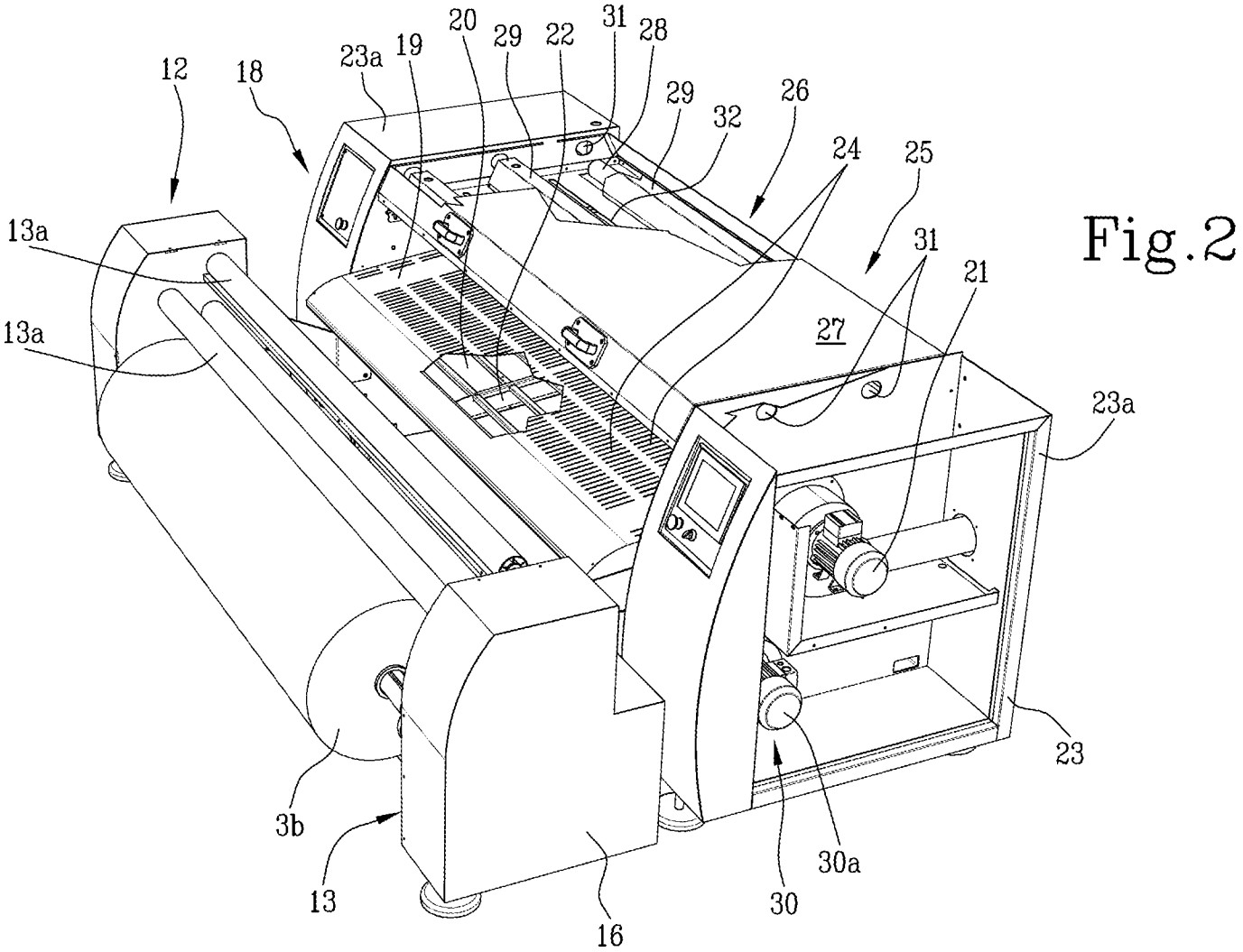
FIG. 2 is a perspective, partially interrupted view of a braking unit and a traction unit arranged in the digital printing apparatus of FIG. 1.
Figure 3:
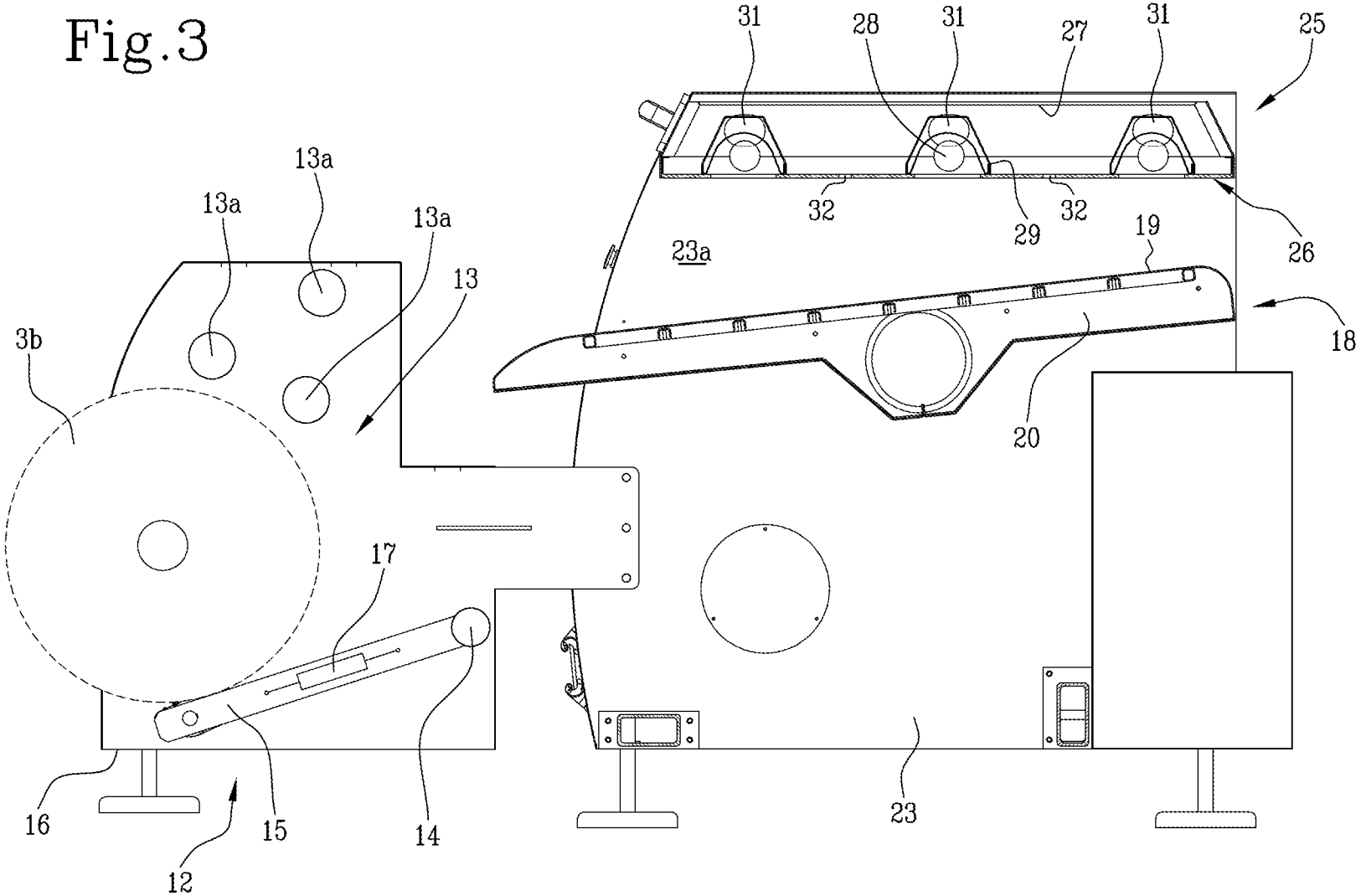
FIG. 3 shows the braking unit sectioned according to a substantially median vertical plane.

With reference to the mentioned figures, the reference number 1 comprehensively indicates a digital apparatus for printing a substrate in the form of a continuous sheet according to the present invention.

The apparatus 1 is adapted to perform a digital printing process on a substrate 3, for example of paper or textile material, fed in the form of a continuous sheet having a width that can indicatively range between 1600 and 3200 mm and over.

The apparatus 1 comprises a feed unit 2 configured to feed the substrate 3 towards a transport group 4. The feed unit 2 can, for example, comprise a feeding support (not shown) arranged to rotatably support the substrate 3, arranged in the form of a feed roller 3*a*, and possibly one or more idler and/or stretching rollers 6, to suitably accompany the substrate 3 which is gradually unwound from the feed roller 3*a* towards the transport group 4.

The transport group 4 comprises at least one belt conveyor 7, suitably motorized, that receives the substrate 3 coming from the feed unit 2 at an input end 4*a*. The belt conveyor 7, suitably motorized, translates the substrate 3 along a predetermined feed direction F, toward an outlet end 4*b* of the transport group 4.

A printing unit 8 operates above the belt conveyor 7, and is configured to realize a print pattern on the substrate 3 laying on the belt conveyor 7. The printing unit 8 usually comprises one or more print heads 9 carried by a carriage 10 alternately movable along a direction which is transverse to the feed direction F of the substrate 3.

The belt conveyor 7 is typically operated according to a step-by-step movement, so as to impose to the substrate 3 a sequence of translation steps alternated with stopping steps, corresponding to the alternate translation of the carriage 10 of the printing unit 8. When the substrate 3 is in the stopped step, the carriage 10 carries out a translational motion outward in order to allow the delivery of ink from the print heads 9. When the substrate 3 is in the movement step, the carriage 10 can perform a return translation to return the print heads 9 to the section from which they started.

To facilitate the correct timing between the movement of the substrate 3 and the movement of the printing unit 8, it is preferably envisaged that the transport group 4 is operatively associated with suitable anchoring devices 11 which assist in the correct adhesion of the substrate 3 itself to the belt conveyor 7. In the example shown, the anchoring devices 11 comprise at least one suction plane 11*a*, 11*b* arranged to exert a suction action through a plurality of through holes (not shown) distributed on the belt conveyor 7. More in particular, a first suction plane 11*a* and a second suction plane 11*b* can be provided, respectively operating upstream of the printing unit 8 and below the same, for example as described in document WO2017/060875. In addition or alternatively, the anchoring action can be achieved in other ways, for example by means of adhesive substances spread on the surface of the belt conveyor 7 and/or by electrostatic systems.

The apparatus 1 further comprises at least one traction unit 12, operating downstream of the transport group 4 for withdrawing the printed substrate 3 coming from the belt conveyor 7. The traction unit 12 can for example comprise a winding group 13 configured to collect the substrate 3 by winding it in the form of a collection roll or reel 3*b*, after passing around one or more idler rollers 13*a*. To determine the translation of the substrate 3 toward the collection reel 3*b*, the same collection reel 3*b* and optionally at least one of the idler rollers 13*a* can be motorized.

Preferably, the traction unit 12 further comprises at least one dancing roller 14 configured to operate on the substrate 3 upstream of the collection reel 3*b*. Preferably, the dancing roller 14 is rotatably carried by a pair of arms 15 oscillatably bound with respect to a supporting base 16, with freedom of rotation around a preferably horizontal axis of oscillation, parallel to the substrate 3. Loading devices 17 comprising, for example, one or more counterweights, springs or other thrust elements not shown, operating on the arms 15 and/or directly on the dancing roller 14 to push the latter against the substrate 3 with a predetermined force. The substrate 3 is therefore subjected to a traction action, preferably constant, correlated to the intensity of the force exerted by the dancing roller 14, which can be adjusted by acting on said loading devices 17.

Between the belt conveyor 7 and the traction unit 12 a braking unit 18 is operably interposed, configured to retain the substrate 3 so as to counteract the traction action induced on the same by the traction unit 12.

Preferably, the braking unit 18 comprises a slide plate 19 configured to be skimmed by the substrate 3, along the path that the substrate 3 itself travels by translating from the transport group 4 towards the traction unit 12.

The slide plate 19, preferably positioned below the substrate 3, can be for example a metal plate having a plurality of through openings, suitably distributed at least in the area skimmed by the substrate 3, or near this area.

The slide plate 19 delimits from above at least one suction chamber 20 subjected to the action of at least one suction unit 21.

More in particular, in the example shown, the slide plate 19 is associated with two suction chambers 20, respectively separated by a central partition 22, arranged parallel to the feed direction F of the substrate 3. The suction chambers 20 are connected laterally, on opposite sides with respect to the slide plate 19, to two suction units 21 each of which is housed within a box-like column 23 which laterally supports the slide plate 19 itself. Each suction unit 21 produces a vacuum inside the respective suction chamber 20, expelling the sucked air into the respective box-like column 23.

The substrate 3 is consequently braked against the slide plate 19 due to the effect of the vacuum produced by means of through openings 24 provided in the slide plate 19. This braking action is distributed, preferably in a uniform manner, along the longitudinal section of the substrate 3 which skims the slide plate 19.

Preferably, the through openings 24 are made in the form of slots extending along a feed direction F of the substrate 3 to favour longitudinal sliding. In order to avoid jamming of and/or damage to the substrate 3, each through opening 24 is preferably provided in the form of a slot with a width below 3 mm, preferably comprised between 1.5 mm and 2 mm. The length of each slot is preferably greater than 20 mm, more preferably comprised between 35 mm and 70 mm.

By adequately modulating the action of the suction units 21, it is possible to adjust the intensity of the braking action induced on the substrate 3 that slides along the slide plate 19. The braking action imparted to the substrate 3 by the braking unit 18 "intercepts" the traction action applied to the substrate 3 by the traction unit 12, so as to prevent the same traction action from wholly propagating along the substrate 3 up to the transport group 4. Consequently, the traction unit 12 can be activated so as to produce a traction action that is also rather strong in the section downstream of the braking unit 18. This traction action is however sufficiently attenuated, or if necessary completely eliminated, in the section of the substrate 3 extending upstream of the braking unit 18.

This circumstance offers the possibility of reducing the anchorage action of the substrate 3, which is required to ensure the stability of the substrate 3 on the belt conveyor 7 during processing, without risking that the substrate 3 can undergo unwanted displacements due to the traction produced by the traction unit 12. The processing of substrates which are particularly delicate and could easily be damaged by the effects of an energetic anchorage action is thus facilitated, also due to the weakening directly at the print area where the substrate 3 itself is wetted by the ink delivered by the printing unit 8. It is also possible to increase, where required, the traction action exerted by the traction unit 12 to ensure more regular and compact winding of the substrate 3 on the collection reel 3*b*, without the risk of compromising the integrity and stability of the substrate 3 itself along the transport group 4.

It is preferably envisaged that the printed substrate 3 is subjected to a drying action performed along a longitudinal section of the substrate interposed between the belt conveyor 7 and the traction unit 12. The drying action makes it possible to dry the ink delivered onto the substrate 3 so as to prevent the transfer of the ink itself between adjacent turns created during the step of winding on the collection reel 3*b*. The drying process also eliminates the excess moisture from the substrate 3, so as to mitigate or eliminate the effect of structural weakening that the same could have as a result of the absorption of the ink.

More in particular, the drying action can advantageously be performed in the same longitudinal section of the substrate 3 affected by the braking action.

It can be advantageously envisaged that the braking unit 18 is integrated with a drying group 25 of the substrate 3. The drying group 25 preferably comprises at least one heater 26 suspended at a spaced position above the slide plate 19.

In the embodiment illustrated, the heater 26 comprises a panel 27, preferably having a box-like structure, whose opposite sides are engaged in respective extensions 23*a* which extend from the box-like columns 23. The heater 26 can comprise one or more radiant elements 28, typically infrared radiation lamps, engaged to one or more reflective elements 29 carried by the panel 27. More in particular, the radiant elements 28 are each housed at a concavity facing the slide plate 19, defined by a respective reflecting element 29.

The radiation produced by the radiant elements 28 and/or reflected towards the substrate 3 determines the drying during the translation along the slide plate 19.

In addition or alternatively, the drying can be advantageously assisted by a ventilation action directed against the substrate 3.

For this purpose, the drying group 25 preferably comprises ventilation devices 30 configured to provide at least one flow of air towards the slide plate 19.

In the example described, these ventilation devices 30 comprise at least one, preferably two ventilation units 30*a*, each housed inside one of the box-like columns 23. Each ventilation unit 30*a* delivers a flow of air through the respective side openings 31 arranged at the top of the box-like columns 23 and/or at the respectively opposite sides of the panel 27. The side openings 31 terminate near a lower surface of the panel 27 and/or within the same, so that the flow of air is directed to skim the radiant elements 28 and/or the inner surfaces of the box-like structure of the panel 27 itself. More in particular, first flows of ventilation produced from the respective ventilation units 30*a* skim the radiant elements 28 in opposed directions and mutually meet below the panel 27 to deviate towards the slide plate 19. In addition or alternatively, second flows of ventilation follow a ventilation path extending inside the box-like structure of the panel 27 and flowing in the direction of the slide plate 19, through vent openings 32 obtained in a lower surface of the panel 27 itself.

The flow of air produced by the ventilation units 30*a* skims the radiant elements 28 and/or the surfaces of the panel 27, removing heat so as to avoid overheating. At the same time, the flow of air thus heated skims the substrate 3 laying on the slide plate 19, facilitating the drying of the printing ink.

The invention claimed is:

1. A digital printing process of a substrate formed as a continuous sheet, comprising the steps of:

feeding to a belt conveyor a substrate formed as a continuous sheet;

laying the substrate on the belt conveyor;

via the belt conveyor, translating the substrate along a feed direction;

forming a printed substrate by realizing a print pattern on the substrate by a printing unit operating above the belt conveyor;

withdrawing the printed substrate by a traction unit operating downstream of the belt conveyor;

subjecting the printed substrate to a braking action between the belt conveyor and the traction unit to retain the printed substrate in contrast to traction actions induced by the traction unit, wherein the braking action is carried out by a suction carried out at through openings formed in a slide plate that is skimmed by the printed substrate.

2. The process according to claim 1, subjecting the printed substrate to a drying action that is implemented along a longitudinal section of the printed substrate interposed between the belt conveyor and the traction unit.

3. The process according to claim 2, performing the drying action with a light radiation produced by radiant elements supported at a spaced position from the printed substrate, and with a ventilation flow directed against the printed substrate.

4. The process according to claim 3, further comprising cooling the radiant elements with the ventilation flow, before directing the ventilation flow against the printed substrate.

5. A digital printing apparatus of a substrate formed as continuous sheet, comprising:

a feeding unit for feeding a substrate formed as a continuous sheet;

a transport group comprising a belt conveyor configured to receive the substrate from the feeding unit and to translate the substrate along a feed direction;

a printing unit operating above the belt conveyor to produce a print pattern on the substrate to form a printed substrate;

a traction unit operating downstream of the transport group to withdraw the printed substrate;

a braking unit operably interposed between the belt conveyor and the traction unit, to retain the printed substrate so as to counteract traction actions induced on the printed substrate by the traction unit;

wherein the braking unit comprises:

a slide plate configured to be slidably skimmed by the printed substrate and having a plurality of through openings;

a suction chamber delimited by the slide plate;

a suction unit configured to create a vacuum inside the suction chamber.

6. The apparatus according to claim 5, wherein the plurality of through openings are formed as slots extending along the feed direction.

7. The apparatus according to claim 5, and further comprising a drying group integrated with the braking unit, drying group configured for drying the printed substrate.

8. The apparatus according to claim 7, wherein the drying group comprises at least one heater suspended at a spaced position from the slide plate.

9. The apparatus according to claim 8, wherein the at least one heater comprises a panel, with opposite sides of the panel engaging with respective extensions, which extend from columns which support the slide plate.

10. The apparatus according to claim 9, wherein the at least one heater comprises radiant elements operatively carried by the panel.

11. The apparatus according to claim 7, wherein the drying group comprises ventilation devices configured to provide a ventilation flow towards the slide plate.

12. The apparatus according to claim 11, wherein the drying group includes at least one heater, the at least one heater comprising radiant elements, wherein the ventilation flow skims the radiant elements before reaching the slide plate.

13. The apparatus according to claim 11, wherein the drying group includes at least one heater, wherein the at least one heater comprises a panel, with opposite sides of the panel engaging with respective extensions, which extend from columns which support the slide plate, wherein the ventilation devices include a ventilation path extending internally towards the panel and exiting in a direction of the slide plate, through one or more vent openings in a lower surface of the panel.

14. A digital printing process of a substrate formed as a continuous sheet, comprising the steps of:

feeding to a belt conveyor a substrate formed as a continuous sheet;

laying the substrate on the belt conveyor;

via the belt conveyor, translating the substrate along a feed direction;

forming a printed substrate by realizing a print pattern on the substrate by a printing unit operating above the belt conveyor;

withdrawing the printed substrate by a traction unit operating downstream of the belt conveyor;

subjecting the printed substrate to a braking action between the belt conveyor and the traction unit to retain the printed substrate in contrast to traction actions induced by the traction unit;

subjecting the printed substrate to a drying action that is implemented along a longitudinal section of the printed substrate interposed between the belt conveyor and the traction unit;

performing the drying action with a light radiation produced by radiant elements supported at a spaced position from the printed substrate, and with a ventilation flow directed against the printed substrate;

cooling the radiant elements with the ventilation flow, before directing the ventilation flow against the printed substrate.

* * * * *